US006243926B1

(12) United States Patent
Takashima et al.

(10) Patent No.: US 6,243,926 B1
(45) Date of Patent: Jun. 12, 2001

(54) ZIP FASTENER

(75) Inventors: Kazuhiko Takashima; Masahiko Futakuchi; Enrique Zaragoza, all of Barcelona; Agustin Jimenez, Tarragona; Francesc Vilarrubi, Barcelona, all of (ES)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/209,685

(22) Filed: Dec. 11, 1998

(30) Foreign Application Priority Data

Dec. 12, 1997 (GB) ..... 9726377

(51) Int. Cl.[7] ..... A44B 19/00
(52) U.S. Cl. ..... 24/403; 24/390
(58) Field of Search ..... 24/403, 402, 413, 24/581, 400, 405, 407, 390, 396

(56) References Cited

U.S. PATENT DOCUMENTS 3,444,598 5/1969 Glindmeyer et al. .
4,125,911 11/1978 Moertel .
4,265,190 * 5/1981 Moertel ..... 112/152

FOREIGN PATENT DOCUMENTS 2 925 831 1/1981 (DE) .
0 414 553 2/1991 (EP) .
0 458 220 11/1991 (EP) .
0 641 637 3/1995 (EP) .
2 634 990 2/1990 (FR) .

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

A zip fastener for fastening two edges of material together, the fastener having a pair of stringers, each stringer comprising a plurality of coupling elements located on an edge of a tape, the fastener further comprising an alignment marks for matching the two edges of material together, wherein the alignment mark is a pair of open holes with an open hole being provided through the tape of each stringer, the pair of holes being located at the same level as one another along the length of the zip fastener.

5 Claims, 3 Drawing Sheets

ZIP FASTENER

BACKGROUND OF THE INVENTION

1. Field of the Invention

The present invention relates to a zip fastener, a method for joining two edges of material together with a zip fastener and apparatus for making a zip fastener. In particular, the present invention is concerned with zip fasteners for joining together two edges of patterned material where the pattern needs to match across the join.

2. Description of the Related Art

Zip fasteners are commonly used for joining together two edges of material. They may be used for providing a closeable slit in a unit e.g. as in a dress zip, or they may be used for joining two separate pieces of material together. They are widely used in a upholstery, clothing etc., with almost any type of material. In many situations, a zip fastener will be used to join together two edges of patterned material. A particular example is the manufacture of car seat covers. In this situation, it is important that the pattern on the two edges of material matches.

Matching two such patterns is an awkward process. A conventional zip fastener has two stringers which are formed from a plurality of coupling elements located on an edge of a tape. The edges of material to be joined are attached to the respective tape and the zip fastener is closed by engaging the coupling elements with a slider. In many situations, it is not practical to attach the material when the zip fastener is closed. Therefore, the zip fastener stringers need to be marked so that the pattern on the edges of the material can be matched with the corresponding position on the stringers.

A method of doing this has been to mark the tapes of the zip fastener stringers with a pen. However, this has many disadvantages. For example, during handling of the pen mark can be rub off. Also, the tape must be marked on its upper and lower surfaces. It is awkward to accurately align pen marks on both of these surface.

SUMMARY OF THE INVENTION

The present invention overcomes the above problem by providing a zip fastener with an alignment mark where the alignment mark extends through the tapes of the stringer.

Holes have been made in the tape of zip fasteners previously for reinforcement purposes. For example, in so called 'fixers' which provide an additional means for securing the coupling elements to the tape. These are formed by making a series of holes next to the coupling elements. The zip fastener is put into an injection mold and a melt is injected into the mold. Also, a similar reinforcement technique has been used at the base of a zip fastener. Here a number of holes are made at the base of the zip fastener and the base of the zip fastener is inserted into an injection mold. Thus, the base of the zip fastener is reinforced with plastic above, below and through the plane of the tape.

In a first aspect, the present invention provides a zip fastener for fastening two edges of material together, the fastener having a pair of stringers, each stringer comprising a plurality of coupling elements located on an edge of a tape, the fastener further comprising an alignment mark (for matching the two edges of material together), wherein the alignment mark is a pair of open holes with an open hole being provided through the tape of each stringer, the pair of holes being located at the same position as one another along the length of the zip fastener.

It is preferable, if the hole on each stringer is located on an opposing side of the line of attachment to the coupling elements, the line of attachment being defined as the line closest to the coupling elements where the edges of the material will be attached to the tape.

By providing the holes between the attachment line and coupling elements the strength of zip is not weakened.

In most situations, the attachment line would be the stitching line where the zip fastener tapes are attached to the material. However, in some cases the material will be glued to the zip fastener. Here, the attachment line is the closest line at which the material is glued to the tape.

It may be preferable if the plurality of alignment marks are provided so that the material can be matched at more than one point. This is particularly useful for long zip fasteners which are used in car seat manufacturer.

Preferably, the two stringers are completely separable.

Preferably, the alignment mark is provided about halfway along the length of the zip fastener.

A second aspect of the present invention provides a method of fastening two edges of patterned material together such that the pattern on the first material edge aligns with the pattern on the second material edge, the method comprising the steps of:

providing a zip fastener;

forming a pair of holes through the zip fastener, wherein the zip fastener has first and second stringers, each stringer comprising a plurality of coupling elements located on a tape, one hole being formed through each stringer, the holes being formed at the same level as each other along the length of the zip fastener;

aligning the first material edge the hole the first stringer;

aligning the second material edge the hole the second stringer; and attaching the first and second material edges to the first and second stringers respectively, the material being attached so that a line of attachment of the edges of material to the tape is located between the hole on the tape and the coupling elements the line of attachment being defined as the line closest to the coupling elements, where the edges of the material are attached to the tapes.

As described above, it may be preferable if the method according to a second aspect of the present invention comprises a step of forming a plurality of alignment marks.

There is also provided apparatus for making a zip fastener according to the present invention, the apparatus comprising a surface for supporting a closed zip fastener, the closed zip fastener having a pair of stringers, each stringer comprising a plurality of coupling elements located on an edge of a tape, the stringers being joined by said coupling elements, the apparatus further comprising means for making a pair of holes in the zip fastener, the means comprising a head with two pins extending towards the zip fastener, the apparatus further comprising means for punching the pins through the tapes of the zip fastener such that a hole is formed in each tape, the holes being level with each other along the length of the zip fastener.

Many zip fastener tapes are made of a polyester type material. If the pins of the head are heated then the heat from the pins will seal the walls of the hole and prevent them from fraying. Therefore, it is more preferable if the pins of the head are heated.

According to a preferred design of apparatus, the head is movable along the length of the tape, thus the head can punch holes at various intervals along the length of the tape.

More preferably, the apparatus further comprises means for feeding the tape over the surface such that lengths of tape can be moved over the surface.

BRIEF DESCRIPTION OF THE DRAWINGS

The present invention will now be described with reference to the following preferred embodiments in which.

DESCRIPTION OF PREFERRED EMBODIMENTS

Figure 1:
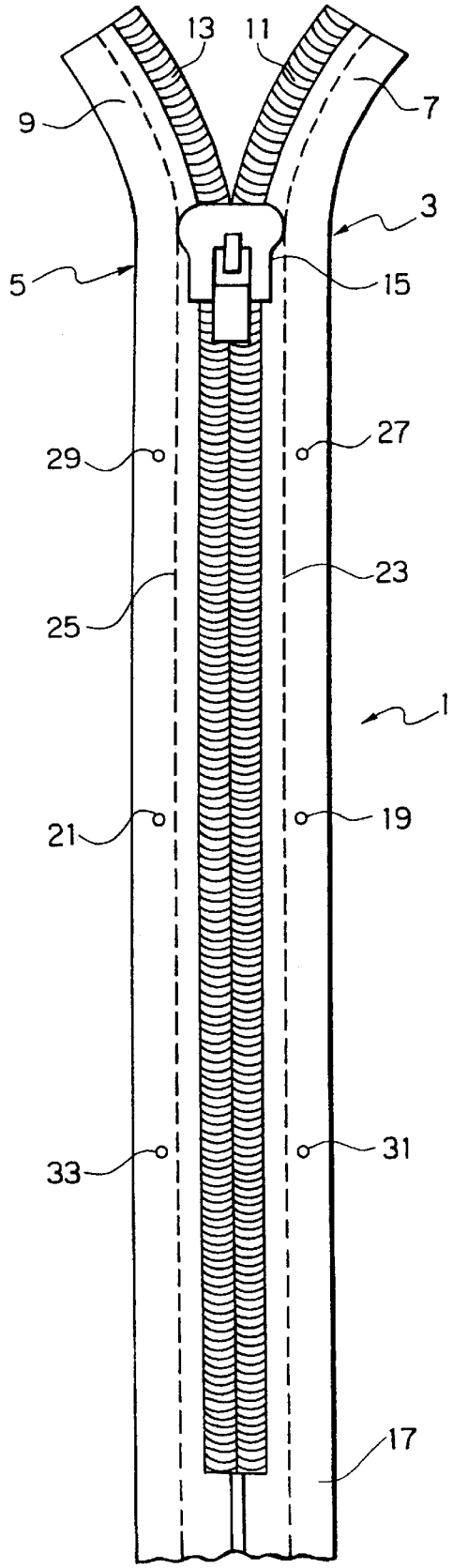
FIG. 1 is a zip fastener in accordance with the first and second aspects of the present invention.

FIG. 1 shows a zip fastener 1. The zip fastener has two stringers 3 and 5. Each stringer 3, 5 is made up of a tape 7, 9 with coupling elements 11, 13 on the edge of the tape 7, 9. The zip fastener 1 is closed when the coupling elements 11 and 13 engage to fix the two stringers 3 and 5 together. The zip fastener is closed by moving slider 15 away from the base 17 of the zip fastener 1.

A pair of holes 19, 21 are located in the middle of the zip fastener 1. The first hole 19 extends through the tape 7 and the second hole 21 extends through the tape 9. The holes are positioned so that they are level with one another. To qualify the term level, a line between holes 19 and 21 is substantially perpendicular to the direction of closer of the zip fastener 1.

The holes 19 and 21 are located such they are lie on the opposing sides of the attachment lines 23, to the coupling elements 11, 13. The attachment lines 23 and 25 are shown as a guide as to where the material will be stitched to the tapes 7, 9. They are not lines which are usually marked on the zip fastener 1 before the material is attached. However, a zip is normally stitched as close to the coupling elements 11, 13 as possible but leaving room for the slider 15 to move.

The holes 19 and 21 are located on the outside of the stitching lines 23, 25, as the holes 19, 21 not to weaken the zip fastener 1.

Further pairs of holes 27 and 29 and 31 and 33 are also shown. These are extra alignment marks which may be required especially if the zip is very long.

Figure 2:
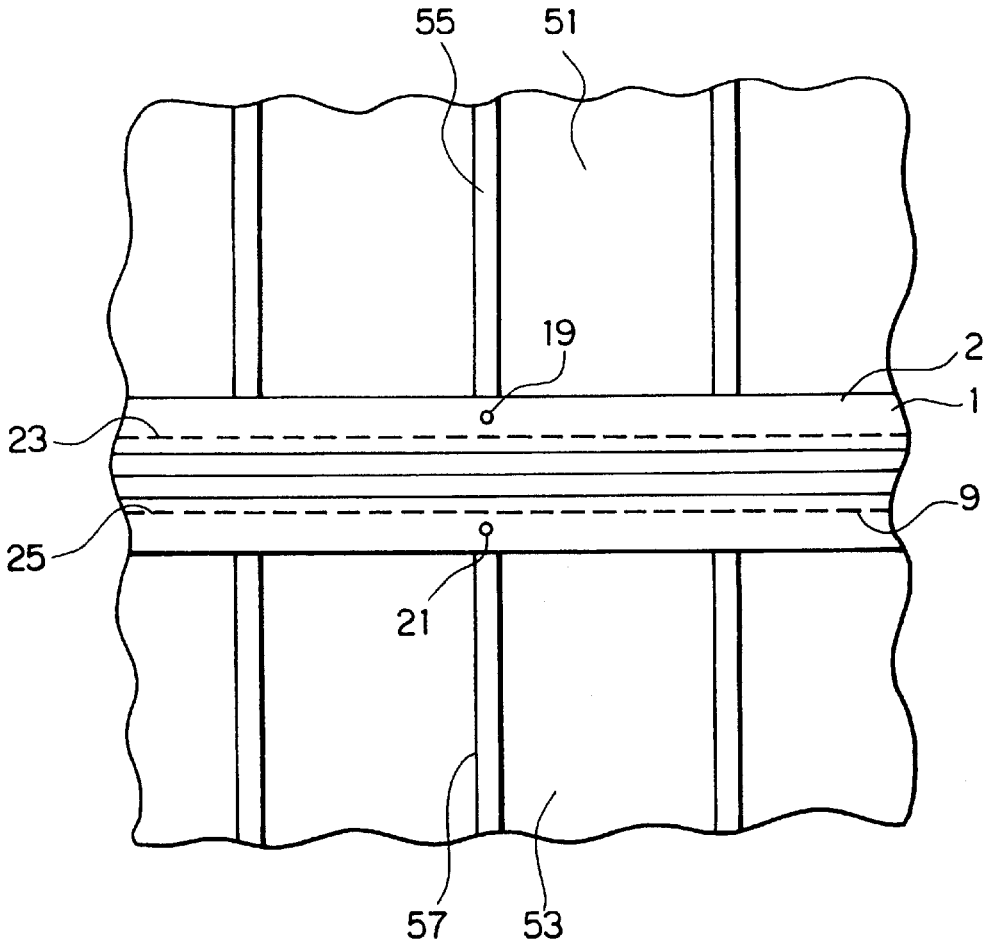
FIG. 2 is an underneath view of the zip fastener of FIG. 1, shown joining two pieces of material together.

FIG. 2 shows the underside of the zipper 1 with two pieces of material 51 and 53 attached to the zipper by stitching on lines 23 and 25. It can be seen that the material 51 and 53 has a striped pattern. Stripe 55 is aligned with hole 19 and stitched to tape 7. Similarly, on the second sheet of material 53, stripe 57 is aligned with hole 21 and stitched along line 25 to the second tape 9. When the zip fastener 1 is closed (as shown in FIG. 1) the pattern aligns. For a long zip, fastener or a more complicated pattern more than one pair of alignment marks may be required.

Figure 3:
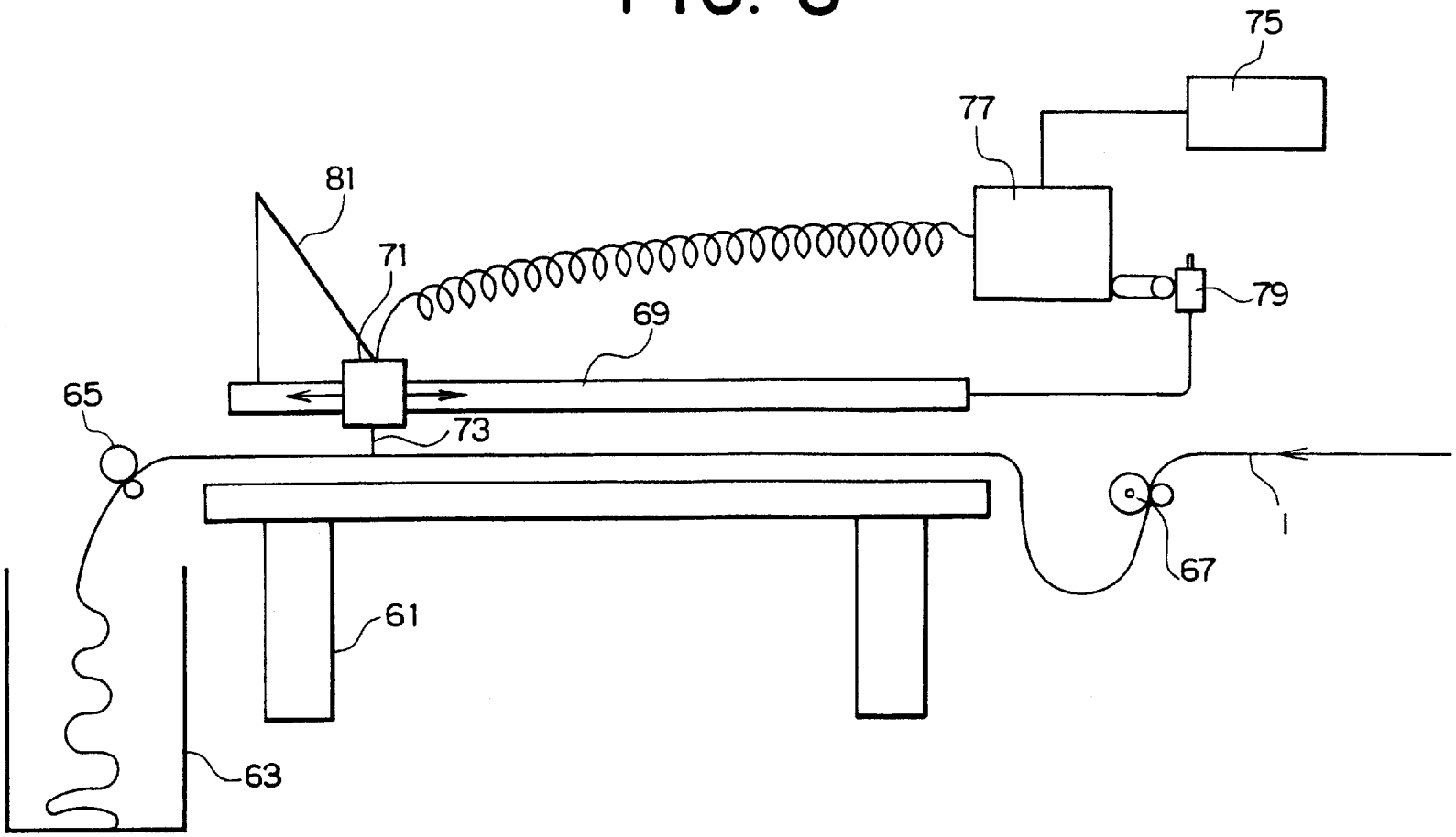
FIG. 3 shows apparatus for fabricating a zip fastener as shown in FIG. 1.

FIG. 3 shows apparatus for making the zip fastener 1 shown in FIG. 1. The zip fastener 1 is fed over the table 61 by wheels 65 and 67. The finished zipper fastener is collected in bin 63. Wheels 65 and 67 have the dual function of securing the zip fastener 1 to the table 61 when the zip fastener is punched, and feeding the zip fastener 1 over the table 61, between punching operations.

Above the table 61 there is a track 69 and a head 71 is movable from right to left along the track 69. Head 71 has a pair of pins 73 which project out of the head 71. Head 71 and pins 73 are heated. The position of the head along the track 69 is determined by controller 75 and the data is fed to the head view control head 77. The head 71 is moved by pneumatic system 79 and pneumatic positioner 81.

When the head 71 reaches the required position on the zip fastener 1, pins 73 are pushed into the zip fastener 1. The zip fastener 1 is aligned with the pins 73 so that holes are formed (e.g. 19 and 21 in FIG. 1) on either side of the coupling elements 11 and 13. The pins 73 are then lifted out of the zip fastener and the head 71 is re-positioned.

Once the zip fastener 1 portion lying on the table has been punched, a fresh piece of zip fastener 1 is moved onto the table 61 and the process starts again.

The operation of the apparatus of FIG. 3 has been described with reference to a single zip fastener 1. However, in practice, it is envisaged that a plurality of zip fasteners which are joined end to end will be continually fed over the table 61. Or a long zipper chain which is to be subdivided into shorter zip fasteners will be fed over the table 61.

What is claimed is:

1. A zip fastener for fastening edges of two pieces of material, the fastener having a pair of stringers, each stringer comprising a plurality of coupling elements located on and extending longitudinally along an edge of a tape for attaching said stringers together, the fastener further comprising an alignment mark, wherein the alignment mark is a pair of open holes with an open hole being provided through the tape of each stringer, the pair of holes being located at the same longitudinal position as one another along the longitudinal length, wherein the coupling elements are secured to their respective stringer along one of a pair of lines of attachment and wherein the holes are located outside of the lines of attachment.

2. A zip fastener according to claim 1, wherein the lines of attachment are each defined as the line closest to the coupling elements where edges of the material will be attached to the tapes.

3. A zip fastener according to claim 1 or 2, wherein the alignment mark is provided halfway along the longitudinal length of the zip fastener.

4. A zip fastener according to claim 1, wherein the fastener comprises a plurality of alignment marks.

5. A zip fastener according to claim 1, wherein the two stringers are completely separable.

* * * * *